US006338586B1

(12) United States Patent
Kuo

(10) Patent No.: US 6,338,586 B1
(45) Date of Patent: Jan. 15, 2002

(54) LOCKING STRUCTURE OF RETRACTABLE DRAW BAR

(75) Inventor: Chung-Hsien Kuo, Taipei Hsien (TW)

(73) Assignee: Chaw Khong Technology Co., Ltd., Taipei Hsien (TW)

( * ) Notice: Subject to any disclaimer, the term of this patent is extended or adjusted under 35 U.S.C. 154(b) by 0 days.

(21) Appl. No.: 09/577,972

(22) Filed: May 25, 2000

(30) Foreign Application Priority Data

Apr. 21, 2000 (TW) ..... 089206582

(51) Int. Cl.[7] ..... F16B 7/10; A45C 3/00
(52) U.S. Cl. ..... 403/109.7; 16/113.1; 190/115
(58) Field of Search ..... 403/109.3, 109.6, 403/109.7, 109.5, 109.2, 378, 322.3, 322.1; 16/113.1, 405; 190/115; 280/655, 655.1, 47.315

(56) References Cited

U.S. PATENT DOCUMENTS 5,458,020 A * 10/1995 Wang ..... 403/109.7 X
5,488,756 A * 2/1996 Hsieh ..... 16/113.1
5,806,143 A * 9/1998 Tsai ..... 16/405
5,862,572 A * 1/1999 Lin et al. ..... 16/405
5,911,263 A * 6/1999 Wu ..... 16/429
6,134,749 A * 10/2000 Kuo ..... 16/113.1
6,141,828 A * 11/2000 Kuo ..... 16/113.1
6,161,253 A * 12/2000 Tu ..... 16/113.1
6,223,391 B1 * 5/2001 Kuo ..... 16/113.1

* cited by examiner

*Primary Examiner*—Harry C. Kim
(74) *Attorney, Agent, or Firm*—Rosenberg, Klein & Lee

(57) ABSTRACT

The present invention proposes an improved locking structure of a retractable draw bar. The proposed improved locking structure comprises a first joint tube, a second joint tube, a fixed assembly, a movable assembly, two click buttons, and two resilient elements. The movable assembly is inserted in the fixed assembly and can steadily move upwards or downwards with respect to the fixed assembly. The upper and lower click buttons and the two resilient elements are axially adjacent and are installed in the fixed assembly to penetrate in the movable assembly. The upper and lower click buttons can work in opposite directions and be secured and positioned in the upper and lower click holes when the draw bar is protracted or retracted. Wedged guide grooves and wedged guide blocks are installed at corresponding positions on the movable assembly and the upper click button, respectively. No matter the movable assembly is pulled upwards or pushed downwards, the upper click button can be pushed sideward and retracted transversely from the click hole. The number of components is reduced and there are higher compatibility and interaction between them. Easy assembly and smooth protraction/retraction and steady positioning of the retractable draw bar can thus be achieved. The present invention can be widely used between any two draw bars. Moreover, the present invention can apply to the upward-pull type or the downward-push type retractable draw bars.

13 Claims, 10 Drawing Sheets

LOCKING STRUCTURE OF RETRACTABLE DRAW BAR

FIELD OF THE INVENTION

The present invention relates to an improved locking structure and, more particularly, to an improved locking structure installed in a retractable draw bar of a travelling case to facilitate the protraction/retraction and the positioning of the retractable draw bar. The retractable draw bar can be pulled upwards or pushed downwards to achieve smoother operation. Moreover, more convenient assembly of the retractable draw bar can be achieved.

BACKGROUND OF THE INVENTION

For a travelling case with rollers installed at the bottom thereof, there is a retractable draw bar allocated to facilitate the protraction/retraction of a draw handle so that the draw handle can be gripped conveniently when used and occupies no space when not used. Moreover, to let the retractable draw bar be positioned at a proper position when protracted, there is a locking structure installed between a first joint tube and a second joint tube to control the retractile state of each joint tube.

With the retractable draw bar of a commercial travelling case as an example, the locking structure has a shell body, which has a top hole and two side holes disposed at two opposite sides. A longitudinally movable control element pushed by a main resilient element is inserted in the top hole. The control element has a first bevel and a second bevel spaced vertically. A first click element and a second click element respectively pushed by the first resilient element and the second resilient element and respectively protruding transversely to the first side hole and the second side hole are installed in the shell body. The two click elements are vertically spaced and have slanting parts corresponding to the first bevel and the second bevel, respectively. When the retractable draw bar is pulled upwards or pushed downwards, the first bevel of the control element can push sideward the slanting part of the first click element or the second bevel of the control element can push sideward the slanting part of the second click element so that the first click element or the second click element will be retracted from the side hole. The retractable draw bar can thus be protracted or retracted freely.

However, the design of this kind of locking structure may generate the following problems in assembly and use.

(1). The components of the locking structure comprises at least a shell body, a control element, a main resilient element, a first click element, a first resilient element, a second click element, and a second resilient element. There are a large number of components having small volumes. The shell body is formed by joining a front shell and a back shell. Moreover, there are many separate resilient elements. Therefore, assembly of the locking structure is time-consuming and laborsome.

(2). Although the first click element and the second click element of the locking structure work in reverse directions to be secured and positioned timely in the upper side hole and the lower side hole when the draw bar is pulled upwards or pushed downwards, they are spaced vertically and work independently. That is, there is no interaction between them. On one hand, this results in increase and dispersion of components. On the other hand, discord may arise between them to deteriorate smooth protraction/retraction and steady positioning of the retractable draw bar.

(3). This kind of locking structure having two click elements is mainly used in each draw bar except the first draw bar and is pushed downwards to work. Another simplified locking structure having only a click element must be used in the first draw bar. This simplified locking structure is also pushed downwards to work. Another working way of pulling upwards via a steel cord can not be used, resulting in limited use.

SUMMARY AND OBJECTS OF THE PRESENT INVENTION

One object of the present invention is to provide an improved locking structure of a retractable draw bar, wherein the number of components thereof is reduced and there are higher compatibility and interaction between them. Easy assembly and smooth protraction/retraction and steady positioning of the retractable draw bar can thus be achieved.

Another object of the present invention is to provide an improved locking structure of a retractable draw bar, which not only can be widely used between any two draw bars of a retractable draw bar, but also applies to both the upward-pull type and the downward-push type retractable draw bars.

To achieve the above objects, a locking mechanism of the present invention comprises a fixed assembly, a movable assembly, an upper click button, a lower click button, and two resilient elements. The movable assembly is inserted in the fixed assembly and can steadily move upwards or downwards with respect to the fixed assembly. The upper click button, the first resilient element, the lower click button, and the second resilient element are axially adjacent and are installed in a transverse allocation hole of the fixed assembly so that the upper click button penetrates in the movable assembly. The upper and lower click buttons can thus work in opposite directions. A wedged guide groove and a wedged guide block both having an upper bevel and a lower bevel are installed at corresponding positions on the movable assembly and the upper click button, respectively. No matter the movable assembly is pulled upwards or pushed downwards, the upper click button can be pushed sideward and retracted transversely from the click hole.

The various objects and advantages of the present invention will be more readily understood from the following detailed description when read in conjunction with the appended drawings, in which:

DETAILED DESCRIPTION OF PREFERRED EMBODIMENT

Figure 1:
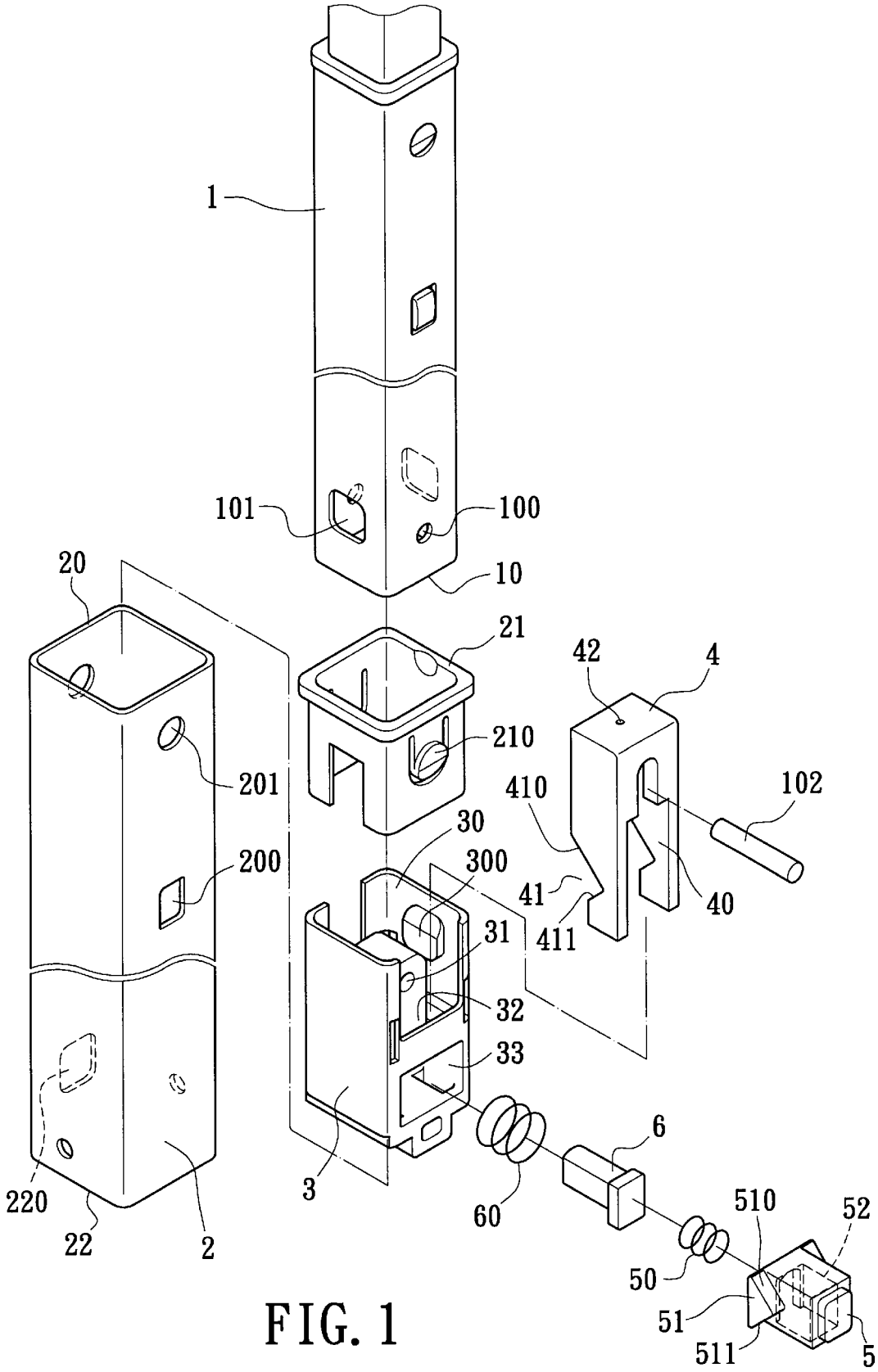
FIG. 1 is an exploded perspective view according to a first embodiment of the present invention.

As shown in FIG. 1, an improved locking structure of a retractable draw bar according to a first embodiment of the present invention comprises a first joint tube 1, a second joint tube 2, a fixed assembly 3, a movable assembly 4, an upper click button 5, and a lower click button 6.

Through holes 100 and positioning holes 101 are disposed on two opposite tube walls near the bottom opening 10 of the first joint tube 1, respectively.

The diameter of the second joint tube 2 is slightly larger than that of the first joint tube 1 so that the first joint tube 1 can be retractably inserted in the second joint tube 2. Buckling holes 201 are disposed on two opposite tube walls near the top opening 20 of the second joint tube 2. An upper click hole 200 is disposed on one tube wall near the top opening 20. A lower click hole 220 is disposed on the opposite tube wall near the bottom opening 22. A tube bushing 21 is sheathed in the top opening 20. Resilient buckling button 210 are formed on two opposite sides of the tube bushing 21 to be secured in the buckling holes 201 so that the tube bushing 21 can be joined at the top opening 20.

An annular groove 30 of a comparable diameter with that of the first joint tube 1 is formed at the top of the fixed assembly 3. Projecting fasteners 300 are formed on two opposite groove walls so that the first joint tube 1 can be inserted in the annular groove 30. The fixed assembly 3 can be joined at the bottom opening 10 of the first joint tube 1 through the fastening of the projecting fasteners 300 in the positioning holes 101. The width of the fixed assembly 3 is comparable with the diameter of the second joint tube 2. When the first joint tube 1 is inserted in the second joint tube 2, the fixed assembly 3 will be situated below the tube bushing 21 so that the first joint tube 1 will be blocked by the tube bushing 21 even when pulled upwards to the highest position. Additionally, a transversely extending penetrated hole 31, an allocation hole 33 corresponding to the upper click hole 200, and a mobile tank 32 vertically crossing and connected to the allocation hole 33 are installed on the fixed assembly 3.

A long guide hole 40 extending a proper length longitudinally is disposed in the movable assembly 4. A wedged guide groove 41 having an upper bevel 410 and a lower bevel 411 is formed on each of the two side walls of the long guide hole 4 adjacent to the fixed assembly 3. The movable assembly 4 is inserted in the mobile tank 32 of the fixed assembly 3. A pin bar 102 is used to penetrate through the long guide hole 40, the penetrated hole 31 of the fixed assembly 3, and the through hole 100 of the first joint tube 1. Therefore, the movable assembly 4 can be joined with the fixed assembly 3 and can steadily move upwards or downwards with respect to the fixed assembly. Moreover, the fixed assembly 3 and the movable assembly 4 are joined at the bottom opening 10 of the first joint tube 1.

The upper click button 5 having a groove 52 to allocate a first resilient element 50 is allocated at one end of the allocation hole 33 of the fixed assembly 3. The upper click button 5 can thus be pressed to protrude in the long guide hole 40 of the movable assembly 4 so as to be secured in the upper click hole 200 of the second joint tube 2 timely. A wedged guide block 51 having an upper bevel 510 and a lower bevel 511 is formed on each of the two sides of the upper click button 5 and is secured in the wedged guide groove 41 of the movable assembly 4.

The lower click button 6 matched to a second resilient element 60 is allocated at the other end of the allocation hole 33 of the fixed assembly 3. The lower click button 6 is disposed axially adjacent to the upper click button 5. The lower click button 6 is sandwiched between the first resilient element 50 and the second resilient element 60 and works in reverse direction with respect to the upper click button 5. The lower click button 6 can thus be secured in the lower click hole 220 of the second joint tube 2 timely.

Figure 2:
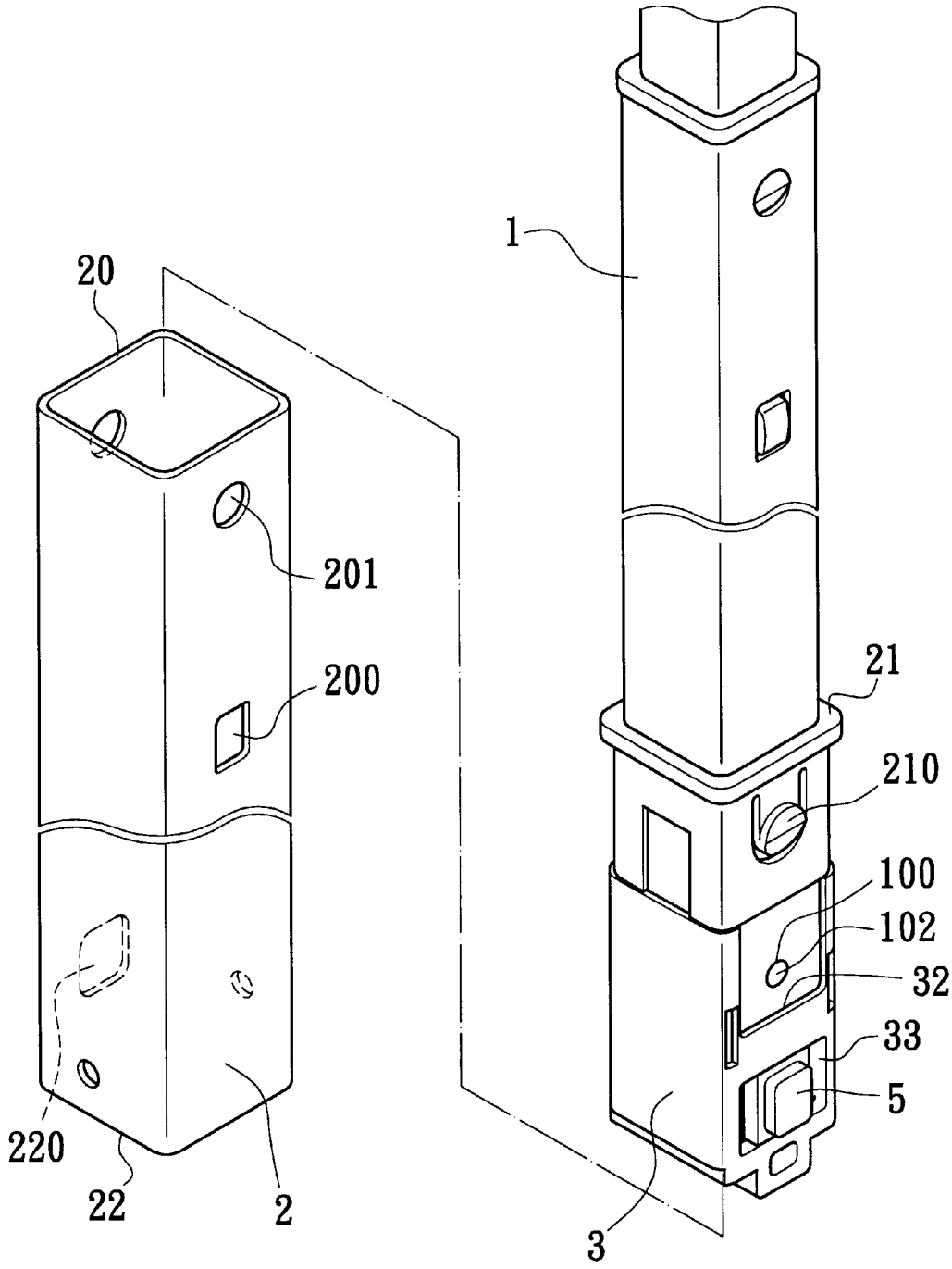
FIG. 2 is a perspective view according to a first embodiment of the present invention.

When the locking structure is to be assembled, the fixed assembly 3, the movable assembly 4, the upper click button 5, the first resilient element 50, the lower click button 6, and the second resilient element 60 can be assembled in advance to form a single entity. After the first joint tube 1 is inserted in the fixed assembly 3 and the pin bar 102 penetrates through the long guide hole 40, the penetrated hole 31, and the through hole 100, the assembled single entity is installed on the first joint tube 1, as shown in FIG. 2. Next, the tube bushing 21 is sheathed on the first joint tube 1. The first joint tube 1 is then inserted in the second joint tube 2. Through the fastening of the tube bushing 21 on the top opening 20, the first joint tube 1 and the second joint tube 2 can be easily joined.

Therefore, the number of components used in the improved locking structure of the present invention is less, and higher compatibility and interaction between them can be achieved. Progressive and systematic production process can thus be achieved so that manpower and time will not be wasted. Moreover, because the fixed assembly 3, the movable assembly 4, the upper click button 5, the first resilient element 50, the lower click button 6, and the second resilient element 60 can be assembled in advance to form a single entity and then preinstalled on the first joint tube 1, the assembled single entity, the first joint tube 1, and the second joint tube 2 can be produced, assembled, stored, and transported separately. Easy and fast assembly of the draw bar can thus be achieved so that production efficiency can be greatly enhanced.

The retractable draw bar in the above embodiment comprises at least three draw bars. The first joint tube 1 and the second joint tube 2 can be any two joined draw bars except the first draw bar. For instance, the first joint tube 1 and the second joint tube 2 are the second and the third draw bars in this embodiment, respectively.

Figure 3:
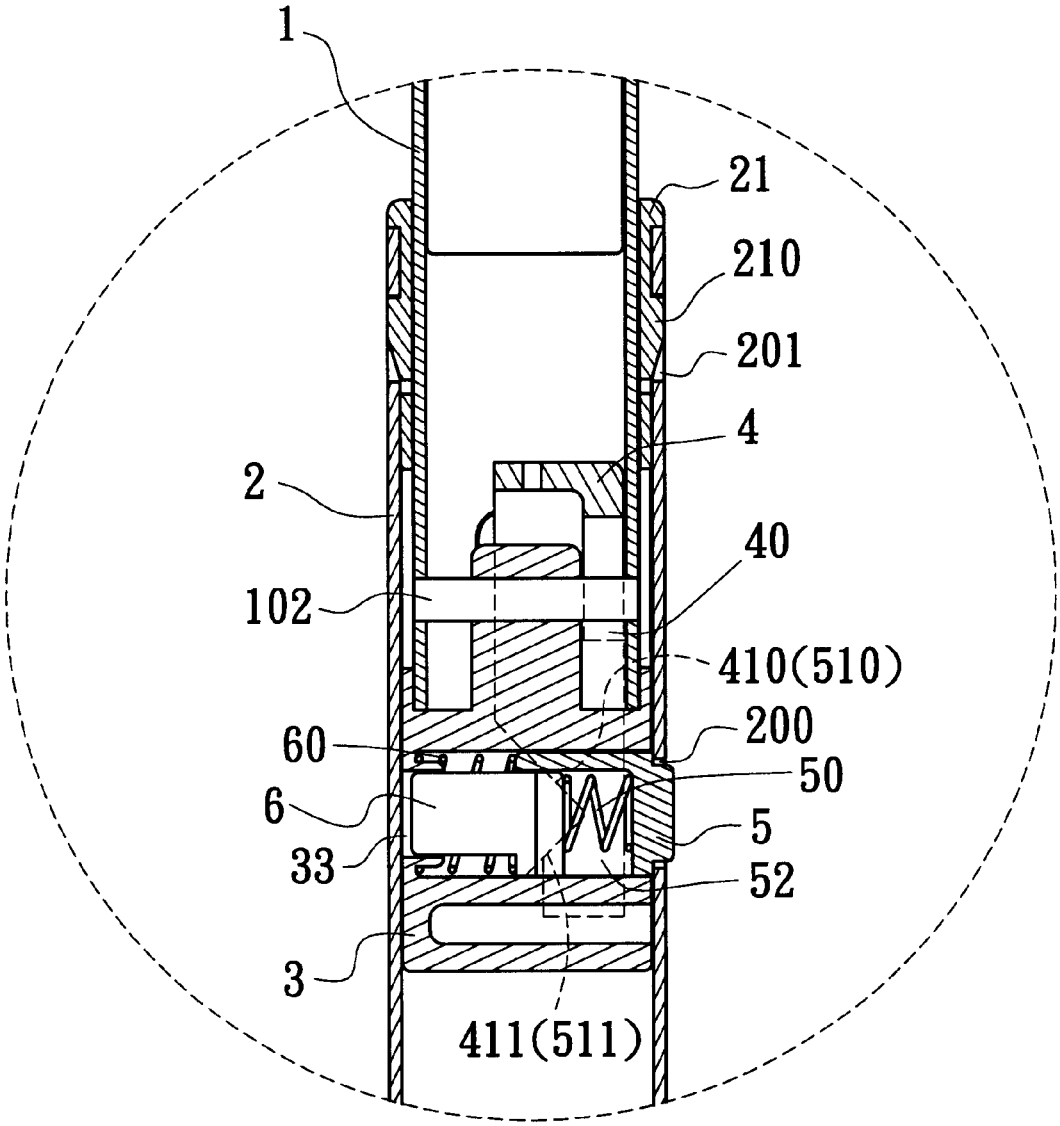
FIG. 3 is an axially cross-sectional view when the first joint tube is pulled upwards with respect to the second joint tube and positioned through the fastening of the upper click button in the upper click hole according to a first embodiment of the present invention.
Figure 4:
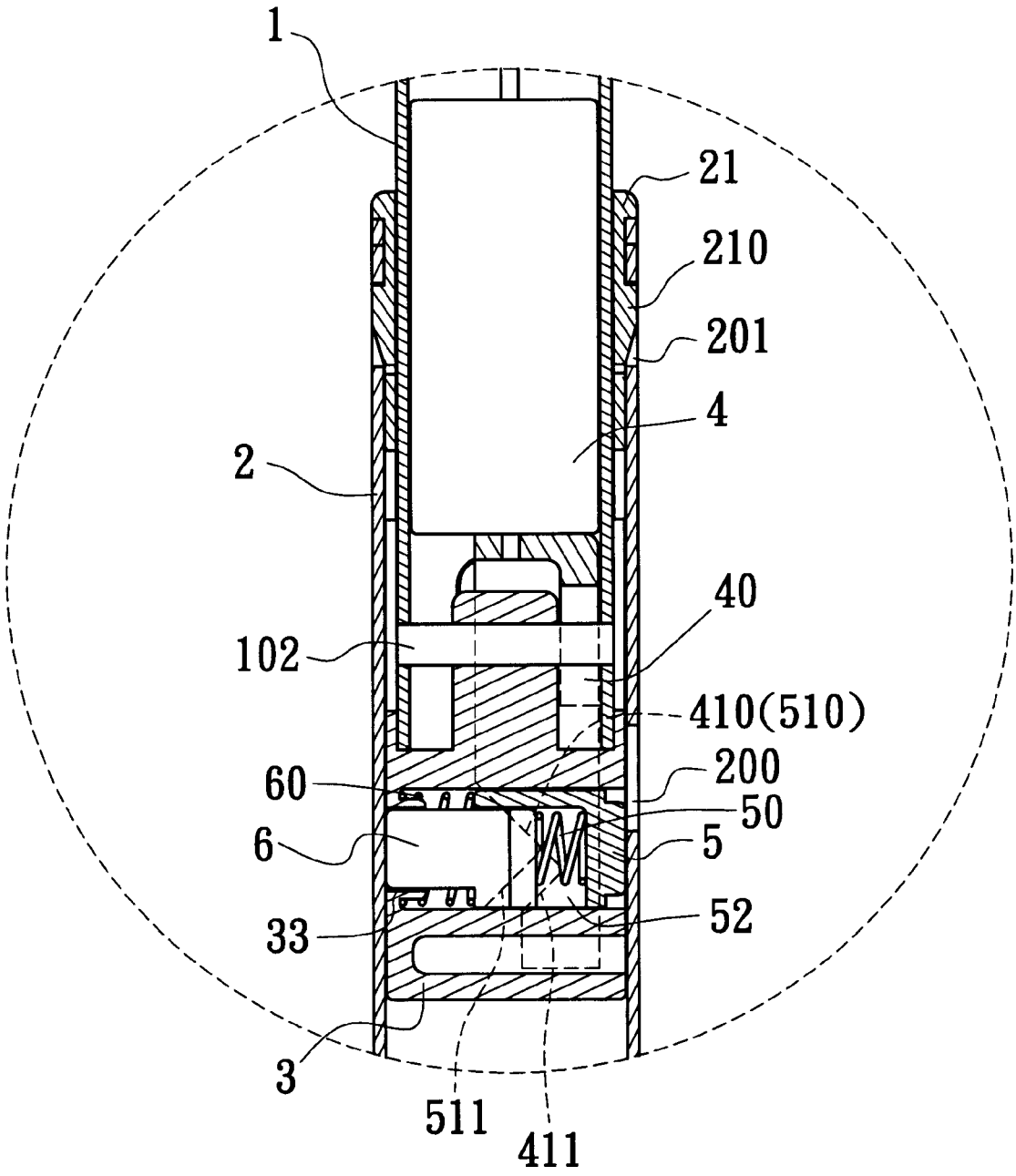
FIG. 4 is an axially cross-sectional view when the upper click button is retracted from the upper click hole so that the first joint tube can be pushed downwards with respect to the second joint tube according to a first embodiment of the present invention.
Figure 5:
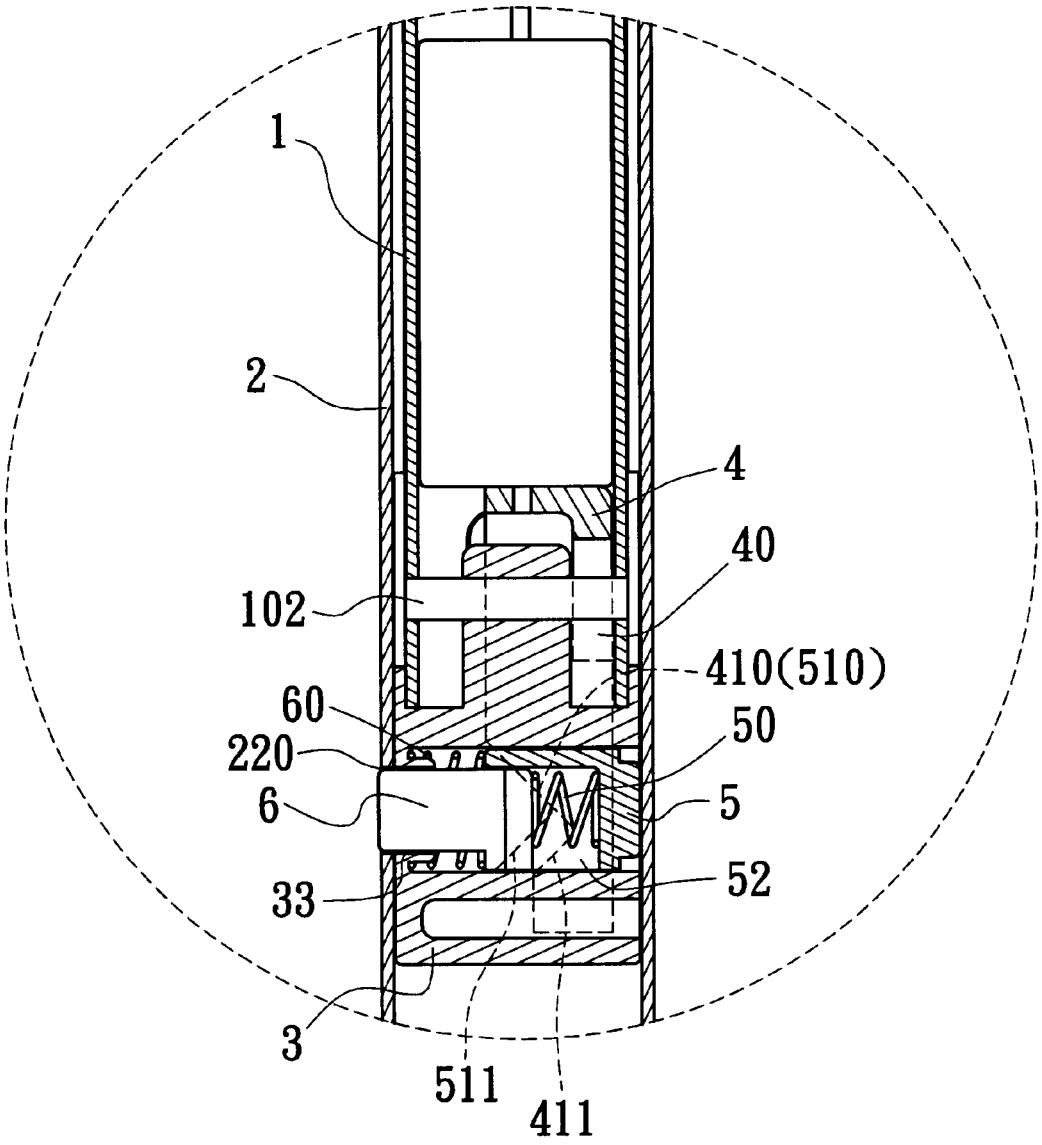
FIG. 5 is an axially cross-sectional view when the first joint tube is pushed downwards to the bottom with respect to the second joint tube and positioned through the fastening of the lower click button in the lower click hole according to a first embodiment of the present invention.

When a user pulls the retractable draw bar upwards, the first joint tube 1 will be pulled upwards with respect to the second joint tube 2 till the fixed assembly 3 sticks to the tube bushing 21, as shown in FIG. 3. At this time, the wedged guide block 51 of the upper click button 5 is locked with the wedged guide groove 41 of the movable assembly 4. The first resilient element 50 and the second resilient element 60 will push the upper click button 5 to be secured in the upper click hole 200. The first joint tube 1 can thus be steadily positioned with respect to the second joint tube 2. When the retractable draw bar is pushed downwards to press the movable assembly 4, as shown in FIG. 4, the upper bevel 410 will smoothly push sideward the upper bevel 511 of the upper click button 5. The click button 5 will be retracted transversely, leave from the click hole 200, and press the first resilient element 50 and the second resilient element 60 to generate higher resilient forces. The first joint tube 1 can thus be retracted freely in the second joint tube 2 till the lower click button 6 moves downwards to the lower click hole 220 and is pressed by the second resilient element 60 to be secured and positioned in the lower click hole 220, as shown in FIG. 5. Therefore, the protraction/retraction of the retractable draw bar is very steady and smooth.

Figure 6:
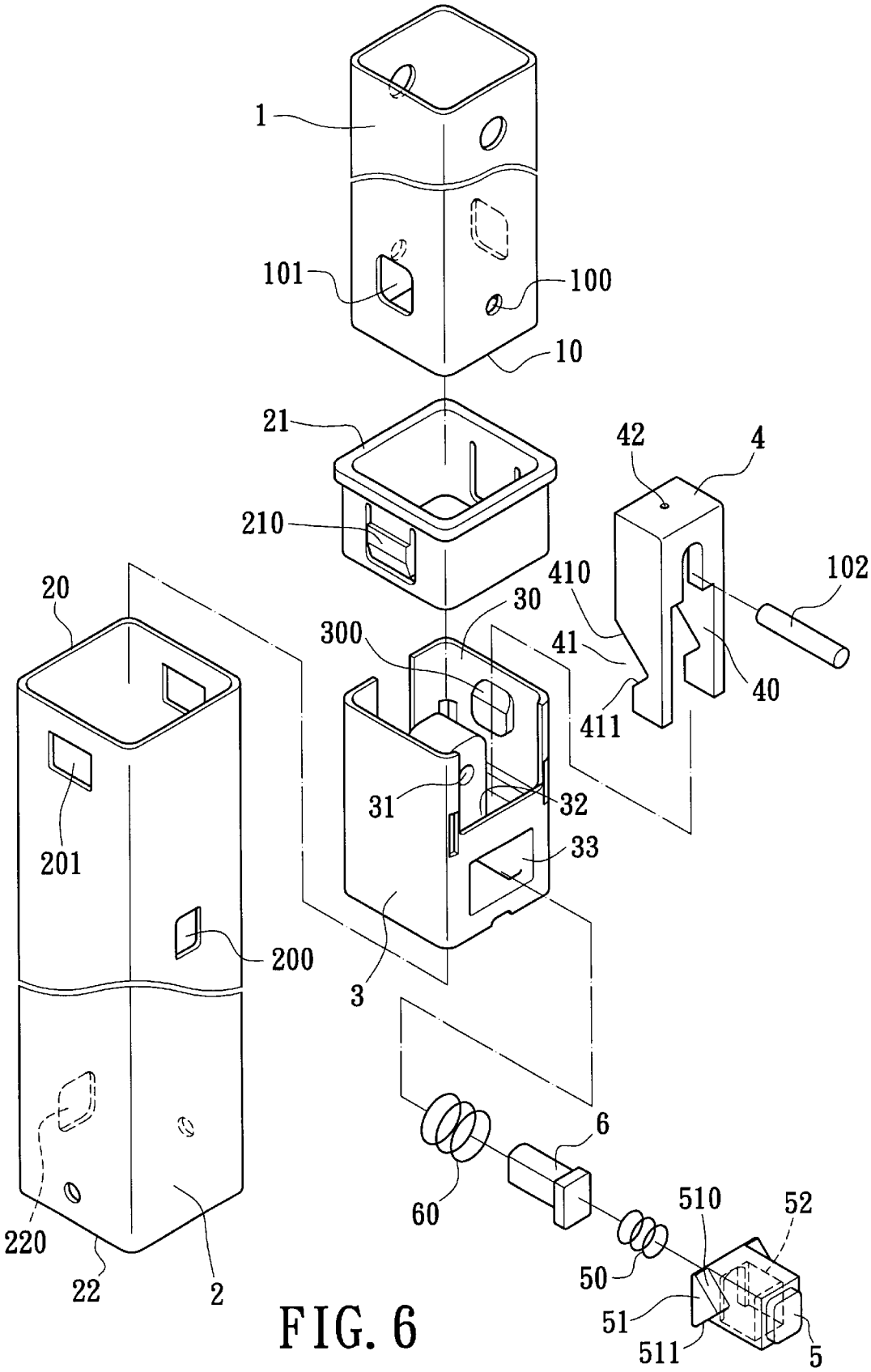
FIG. 6 is an exploded perspective view according to a second embodiment of the present invention.
Figure 7:
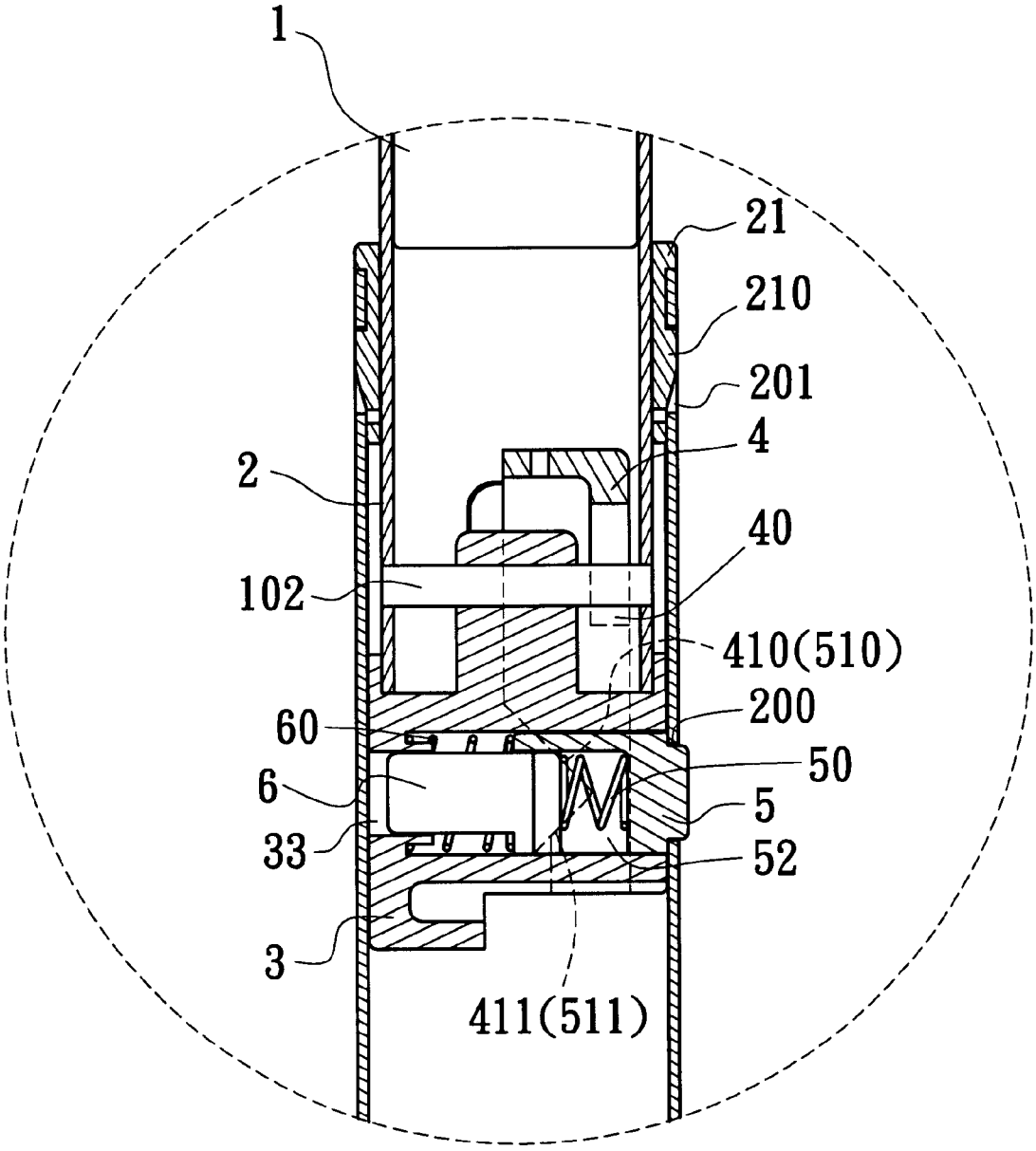
FIG. 7 is an axially cross-sectional view when the first joint tube is pulled upwards with respect to the second joint tube and positioned through the fastening of the upper click button in the upper click hole according to a second embodiment of the present invention.
Figure 8:
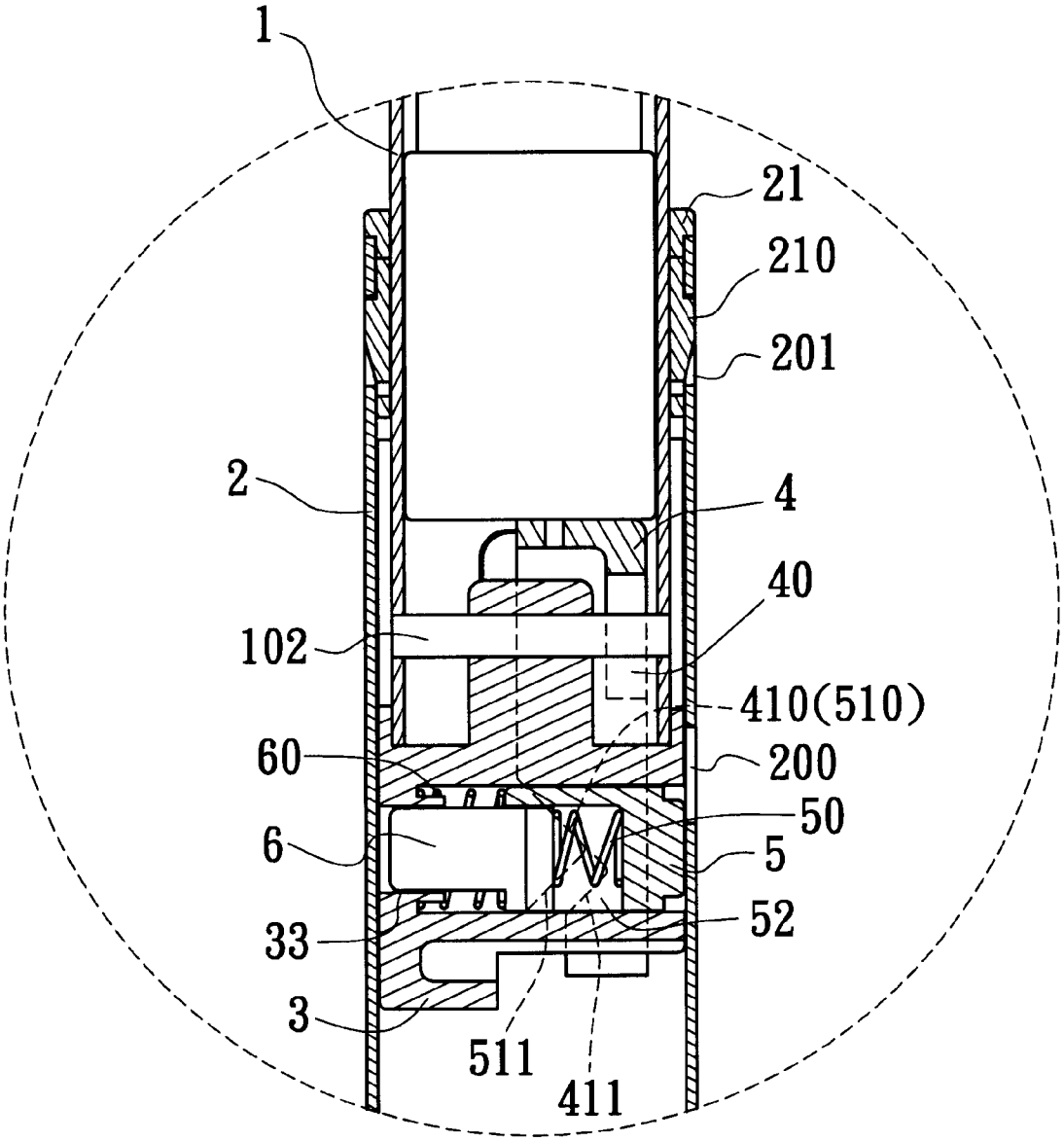
FIG. 8 is an axially cross-sectional view when the upper click button is retracted from the upper click hole so that the first joint tube can be pushed downwards with respect to the second joint tube according to a second embodiment of the present invention.

As shown in FIGS. 6 to 8, the retractable draw bar comprises at least four draw bars according to a second embodiment of the present invention. Similarly, the third draw bar is the first joint tube 1, and the fourth draw bar is the second joint tube 2. The locking mechanism and operation principles are the same as those in the first embodiment.

Figure 9:
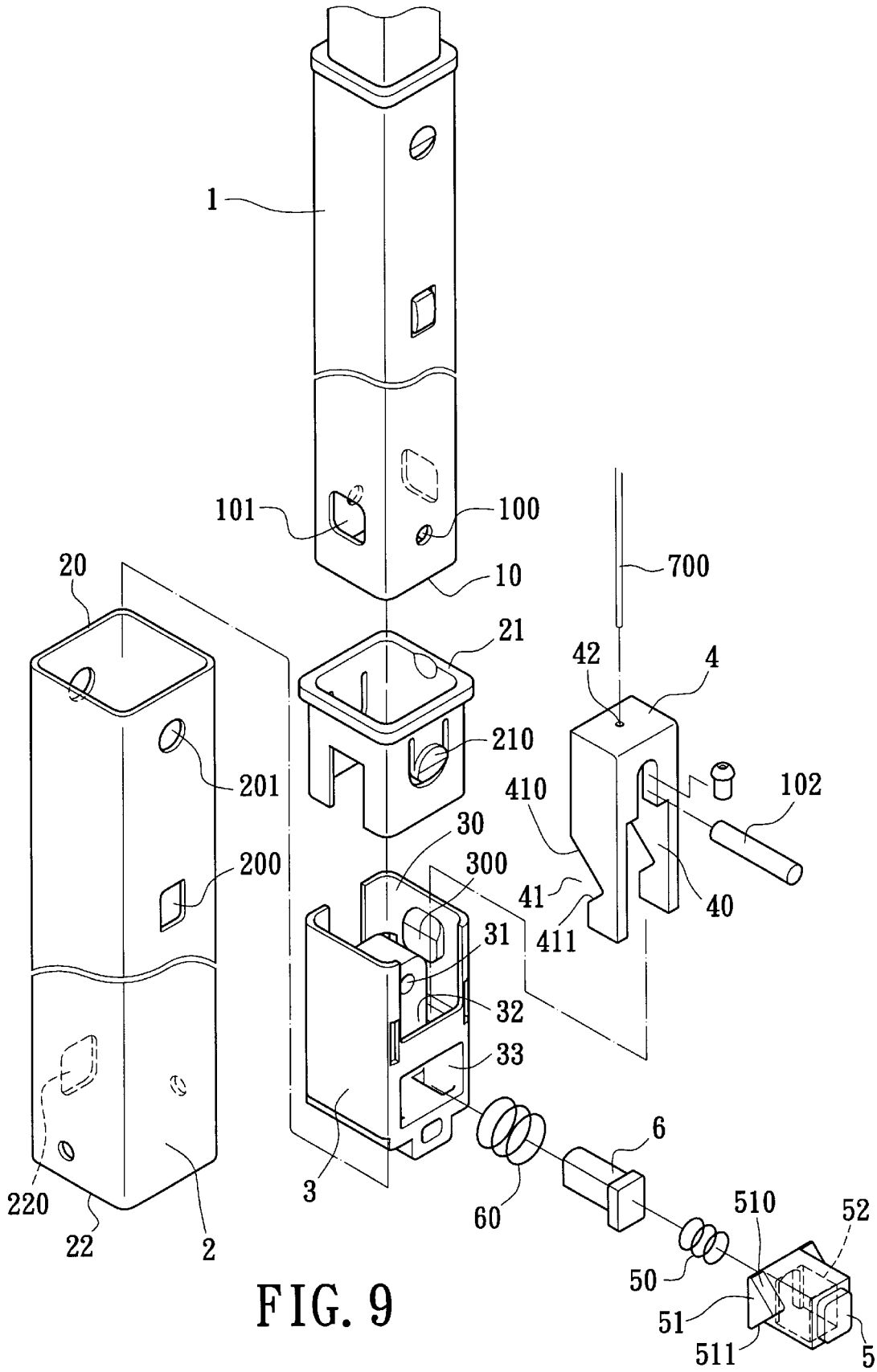
FIG. 9 is an exploded perspective view according to a third embodiment of the present invention.
Figure 10:
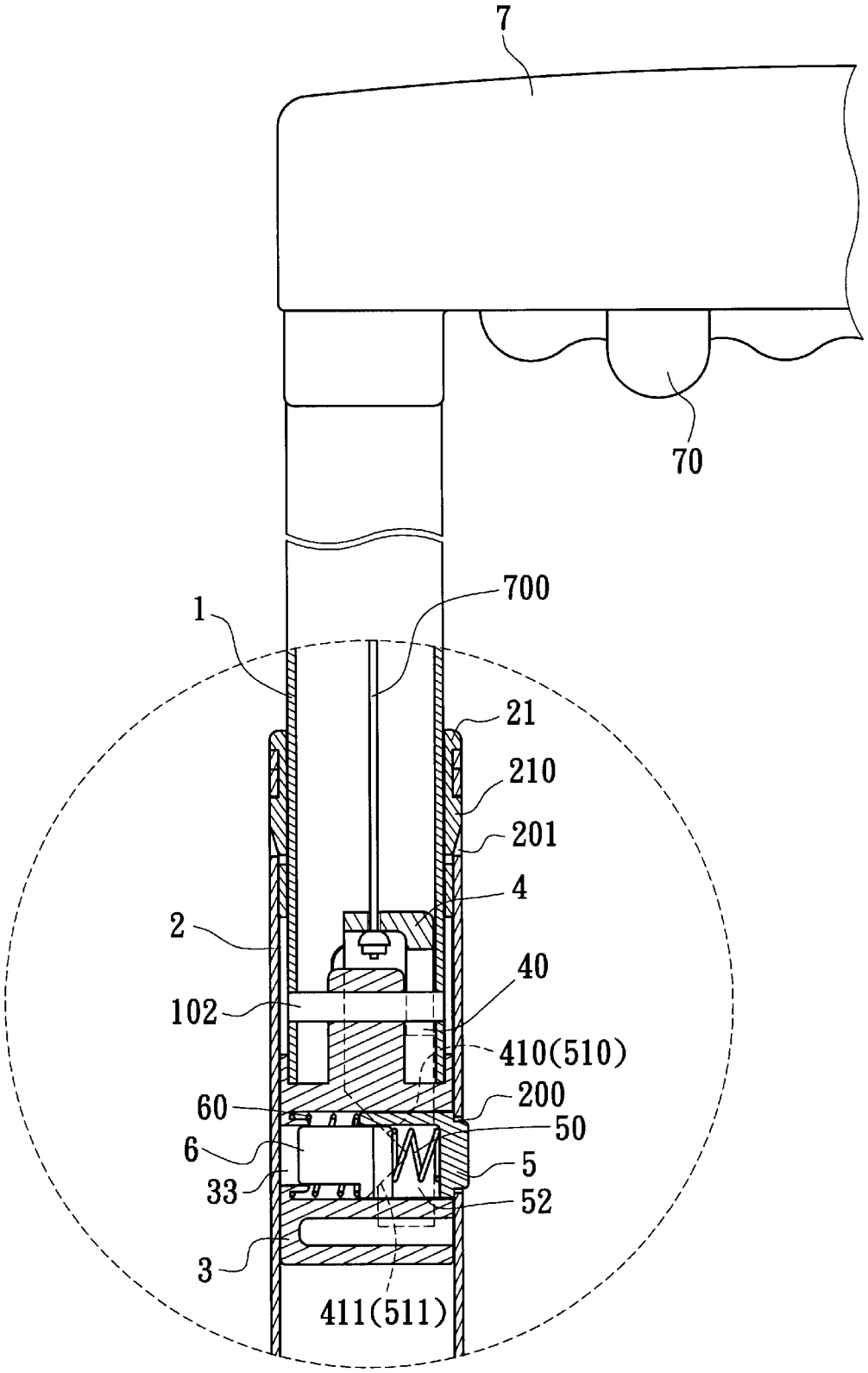
FIG. 10 is an axially cross-sectional view when the first joint tube is pulled upwards with respect to the second joint tube and positioned through the fastening of the upper click button in the upper click hole according to a third embodiment of the present invention.

It is noted that the present invention also applies to the first draw bar and the second draw bar of a retractable draw bar, as shown in FIGS. 9 and 10. It is only necessary to connect a connection hole disposed on the movable assembly 4 and a working element 700 controlled by a push mechanism 70 of a draw handle 7 where the working element 700 may be formed by a soft steel cord or a hard steel rod. A soft steel cord may be used as the working element 700 to pull the movable assembly 4 upwards by a pulling force. Because there are the lower bevel 511 and the lower bevel 411 respectively installed on the wedged guide block 51 of the upper click button 5 and the wedged guide groove 41 of the movable assembly 4, the lower bevel 411 can push sideward the lower bevel 511 to let the upper click button 5 be retracted. Alternatively, a hard steel rod can also be used as the working element 700 to pull the movable assembly 4 upwards by a pulling force. Moreover, using the upper bevel 410 to push sideward the upper bevel 510 to let the upper click button 5 be retracted, the hard steel rod can also push the movable assembly 4 downwards by a pushing force.

In other words, the locking structure comprising the fixed assembly 3, the movable assembly 4, the upper click button 5, the first resilient element 50, the lower click button 6, and the second resilient element 60 not only can apply to draw bars except the first draw bar for passive operation, but also can apply to the first draw bar for active operation. Moreover, the locking structure of the present invention can apply to the upward-pull type or the downward-push type retractable draw bars. More versatile use and wider range of use can thus be achieved.

Although the present invention has been described with reference to the preferred embodiments thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A locking system for a retractable draw bar comprising:

a longitudinally extended first joint tube first joint tube having a bottom end portion defined thereon;

a second joint tube coaxially receiving in retractable manner at least a portion of said first joint tube, said second joint tube having opposed first and second tube walls extending longitudinally between top and bottom end portions, said second joint tube having an upper click hole formed through said first tube wall adjacent said top end portion and a lower click hole formed through said second tube wall adjacent said bottom end portion;

a fixed assembly fixedly engaging said bottom end portion of said first joint tube, said fixed assembly having an allocation hole extending transversely therethrough;

a movable assembly displaceably coupled to said fixed assembly for reversible longitudinal displacement relative thereto, said movable assembly having an inner wall portion formed about a longitudinally extended guide hole, said inner wall portion having a first wedged guide structure formed therein;

an upper click button displaceably disposed in said allocation hole of said fixed assembly for transverse displacement between first and second positions relative to said fixed assembly, said upper click button including a main portion and a second wedged guide structure protruding therefrom, said upper click button being biased by a first resilient member toward said first position, said upper click button in said first position passing transversely through said guide hole of said movable assembly to engage said upper click hole of said second joint tube, said second wedged guide structure in said first position retentively engaging said first wedged guide structure of said movable assembly, said upper click button in said second position being disengaged from said upper click hole of said second joint tube;

a lower click button disposed in said allocation hole of said fixed assembly in substantial transverse alignment with said upper click button for transverse displacement relative to said fixed assembly between extended and retracted positions, said lower click button being biased by a second resilient member toward said extended position, said lower click button in said extended position engaging said lower click hole of said second joint tube, said lower click button in said retracted position being disengaged from said lower click hole of said second joint tube;

whereby said movable assembly is displaceable responsive to user manipulation thereof to disengage said second wedged guide structure from said first wedged guide structure to thereby displace said upper click button from said first position to said second position, said first joint tube being released thereby for longitudinal adjustment relative to said second joint tube.

2. The locking system as recited in claim 1 wherein first wedged guide structure includes a wedged guide groove portion, and said second wedged guide structure includes a wedged guide block portion.

3. The locking system as recited in claim 1 further comprising a tube bushing coupled to said top end portion of said second joint tube.

4. The locking system as recited in claim 3 wherein said tube bushing has formed respectively on opposed sides thereof a pair of resilient buckling buttons, said second joint tube having formed adjacent said top end portion thereof a pair of buckling holes respectively engaging said resilient buckling buttons.

5. The locking system as recited in claim 3 wherein said fixed assembly has formed respectively on opposing wall surfaces thereof a pair of transversely projecting fasteners, said first joint tube having formed respectively in opposing wall surfaces thereof a pair of positioning holes, each said positioning hole lockingly engaging one said projecting fastener of said fixed assembly.

6. The locking system as recited in claim 1 wherein said fixed assembly is limited in upward longitudinal displacement by the abutting engagement of an upper edge portion thereof with a lower edge portion of said tube bushing.

7. The locking system as recited in claim 1 wherein said first joint tube has formed respectively in opposed wall surfaces thereof adjacent said bottom end portion thereof a pair of through holes, said fixed assembly having formed therein a transversely penetrated through hole aligned with said through holes of said first joint tube, said first joint tube and said fixed assembly being secured one to the other by a pin bar engaging said through holes thereof.

8. The locking system as recited in claim 1 wherein said fixed assembly defines a mobile tank communicating with said allocation hole, said mobile tank receiving therein at least a portion of said movable assembly.

9. The locking system as recited in claim 1 further comprising a third joint tube coupled to one of said first and second joint tubes.

10. The locking system as recited in claim 1 further comprising a draw handle having a push mechanism and a working element coupled in responsively displaceable manner thereto, said working element extending through said first joint tube.

11. The locking system as recited in claim 10 wherein said working element includes a flexible metallic cord.

12. The locking system as recited in claim 10 wherein said working element includes a rigid metallic rod.

13. The locking system as recited in claim 12 wherein said working element is operable to alternatively impart a longitudinally upward and a longitudinally downward force upon said movable assembly.

* * * * *